US009562701B2

(12) United States Patent
Kato et al.

(10) Patent No.: US 9,562,701 B2
(45) Date of Patent: Feb. 7, 2017

(54) TEMPERATURE CONTROL SYSTEM AND AIR CONDITIONING SYSTEM

(75) Inventors: Yohei Kato, Tokyo (JP); Koji Matsuzawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 612 days.

(21) Appl. No.: 14/113,465

(22) PCT Filed: May 31, 2011

(86) PCT No.: PCT/JP2011/062470

§ 371 (c)(1),
(2), (4) Date: Oct. 23, 2013

(87) PCT Pub. No.: WO2012/164684

PCT Pub. Date: Dec. 6, 2012

(65) Prior Publication Data

US 2014/0041848 A1 Feb. 13, 2014

(51) Int. Cl.
*F24F 11/00* (2006.01)
*F24F 5/00* (2006.01)

(52) U.S. Cl.
CPC ..... *F24F 11/006* (2013.01); *F24F 11/008* (2013.01); *F24F 5/0003* (2013.01); *F24F 2011/0013* (2013.01); *F24F 2011/0061* (2013.01); *F24F 2011/0063* (2013.01)

(58) Field of Classification Search
CPC . F24F 11/006; F24F 2011/0013; F24F 11/008; F24F 2011/0063; F24F 2011/0061
USPC ..... 165/299, 300
See application file for complete search history.

(56) References Cited

U.S. PATENT DOCUMENTS 4,660,759 A * 4/1987 Barnard ..... F24F 11/0009 165/238
5,408,837 A * 4/1995 Omura ..... F24F 11/00 62/158
5,765,383 A * 6/1998 Inoue ..... B60H 1/3205 62/209
7,386,988 B1 * 6/2008 Petschauer ..... F24F 5/0071 236/44 R (Continued)

FOREIGN PATENT DOCUMENTS

CN 102770718 A 11/2012
JP 58-024741 A 2/1983

(Continued)

OTHER PUBLICATIONS

International Search Report of the International Searching Authority mailed Jul. 19, 2011 for the corresponding international application No. PCT/JP2011/062470 (and English translation).

(Continued)

*Primary Examiner* — Devon Russell
(74) *Attorney, Agent, or Firm* — Posz Law Group, PLC

(57) ABSTRACT

A controller performs a first control that controls a temperature of water (heat medium) flowing out of a heat source device on the basis of an outside air temperature and a temperature difference between chronologically preceding and following outside air temperatures that are detected by an outdoor temperature sensor. The controller controls the temperature of the subject to be controlled to a target temperature by performing the first control.

13 Claims, 3 Drawing Sheets

(56) References Cited

U.S. PATENT DOCUMENTS

| | | | | |
|---|---|---|---|---|
| 2003/0010047 | A1* | 1/2003 | Shimoda | F25B 13/00 62/228.3 |
| 2003/0158704 | A1* | 8/2003 | Triginai | B60H 1/00585 702/182 |
| 2005/0288822 | A1* | 12/2005 | Rayburn | F24F 11/006 700/276 |
| 2007/0063059 | A1* | 3/2007 | Votaw | F24F 3/001 236/1 B |
| 2012/0042674 | A1* | 2/2012 | Takenaka | F24F 3/06 62/180 |
| 2012/0291468 | A1 | 11/2012 | Kato et al. | |
| 2013/0173068 | A1* | 7/2013 | Miwa | G05D 23/19 700/276 |

FOREIGN PATENT DOCUMENTS

| | | | |
|---|---|---|---|
| JP | 62-141470 | A | 6/1987 |
| JP | 2-33055 | Y2 | 9/1990 |
| JP | 4-47566 | Y2 | 11/1992 |
| JP | 04-327738 | B2 | 11/1992 |
| JP | 05-340591 | A | 12/1993 |
| JP | 06-137645 | A | 5/1994 |
| JP | 07-004713 | A | 1/1995 |
| JP | 10-054571 | A | 2/1998 |
| JP | 10-141745 | A | 5/1998 |
| JP | 2899437 | B2 | 3/1999 |
| JP | 11-159844 | A | 6/1999 |
| JP | 2000-304329 | A | 11/2000 |
| JP | 2000304329 | A * | 11/2000 |
| JP | 2006-329529 | A | 12/2006 |
| JP | 2007-212085 | A | 8/2007 |
| JP | 2008-002795 | A | 1/2008 |
| JP | 2010-112683 | A | 5/2010 |

OTHER PUBLICATIONS

Extended European Search Report issued on Jun. 1, 2015 in the corresponding EP application No. 11866717.9.
CN OA issued on Jun. 30, 2015 in the corresponding CN application No. 201180071265.5 ( English translation attached ).
Office Action mailed Jul. 29, 2014 issued in corresponding JP patent application No. 2013-517744 (and English translation).

* cited by examiner

TEMPERATURE CONTROL SYSTEM AND AIR CONDITIONING SYSTEM

CROSS REFERENCE TO RELATED APPLICATION

This application is a U.S. national stage application of PCT/JP2011/062470 filed on May 31, 2011.

TECHNICAL FIELD

The present invention relates to a control technique that achieves high operating efficiency by causing a heat source device to change a water temperature in accordance with a load in an air conditioning system in which a load device and the heat source device are connected by a water circuit.

BACKGROUND

Hitherto, a typical air conditioning system is known in which a heat source unit, such as a heat pump, generates cold/hot water and in which a water pump conveys the cold/hot water to perform cooling/heating of an indoor space. The air conditioning system of this method typically adopts a method in which water is sent at a constant water temperature irrespective of the load, by, for example, supplying cold water of 16 degrees C. to the indoor unit during cooling and supplying hot water of 35 degrees C. to the indoor unit during heating. With this method, in a period in-between seasons or in a case in which the load is small, intermittent operation, such as stopping the heat source unit or stopping the supply of water to the indoor unit with a three-way valve, is carried out when a room temperature reaches a preset value. Accordingly, comfort is compromised and operating efficiency is reduced.

Furthermore, some air conditioning systems include a function that allows a business person in charge of installation to set a target water temperature in accordance with the outside air temperature. No problem will occur if the water temperature and the load match each other; however, under some conditions, an operation with insufficient power may be carried out in which the water temperature is low with respect to the load, or an operation with excessive power may be carried out in which the water temperature is high with respect to the load. Accordingly, a decrease in comfort and operating efficiency is, likewise, brought about.

As a measure to overcome these problems, Patent Literature 1 discloses a control method in which a target temperature of the water supplied by the heat source unit is reset on the basis of a variation between a target indoor temperature that has been set by a user and the current indoor temperature and in which a target water flow rate is reset on the basis of a variation between the reset target water temperature and the current target water temperature. Specifically, the air conditioning system of Patent Literature 1 is provided with a refrigerant circuit including a compressor, a decompression device, and a heat exchanger and with a cold/hot water circulating circuit that is capable of exchanging heat with the refrigerant circuit. The cold/hot water circulating circuit supplies cold/hot water to the indoor units. This air conditioning system sets a new target water temperature from a variation between the current indoor temperature and the target indoor temperature and changes the power of the heat source unit, that is, the frequency of the compressor, so that the water temperature reaches a target value.

PATENT LITERATURE

Patent Literature 1: Japanese Unexamined Patent Application Publication No. 2007-212085 (FIG. 3 and FIG. 4)

In the air conditioning system described above, in order to achieve a highly efficient operation while maintaining comfort, not only the water temperature needs to be changed in accordance with the load, but a water temperature variation range needs to be changed in accordance with the load, that is, a water temperature setting that suppresses overshooting or undershooting of the indoor temperature with respect to the preset temperature is needed when there is a change in the load. For example, a water temperature variation range in a case of a low outside air temperature and a high outside air temperature during "a heating operation" with a fixed preset temperature will be discussed. When the outside air temperature is low, the difference between the preset temperature and the outside air temperature is large. Accordingly, it can be said that the indoor load for satisfying the preset temperature is large. Additionally, when the outside air temperature is high, the difference between the preset temperature and the outside air temperature is small. Accordingly, it can be said that the indoor load is small. For example, in a case in which the outside air temperature changes from a low temperature to a high temperature from dawn to noon, the load decreases and, thus, the power required for the heat source unit decreases. On the other hand, in a case in which the outside air temperature changes from a high temperature to a low temperature from noon to dawn, the load increases and, thus, the power required for the heat source unit increases. In other words, the power required for the heat source unit differs according to the change in the outside air temperature.

Furthermore, the indoor temperature is affected by the change in the outside air temperature, and the change in the indoor temperature becomes apparent later than the change in the outside air temperature due to the influence of the heat capacity of a building. Therefore, the power of the heat source unit lags behind the load change.

That is to say, as disclosed in Patent Literature 1, when the water temperature is changed only through the difference between the preset temperature and the indoor temperature, the change in the water temperature, which is carried out by controlling the power of the heat source unit, occurs later than the change in the load accompanied by the change in the outside air temperature. Accordingly, overshoot or undershoot of the indoor temperature with respect to the preset temperature occurs and, likewise, comfort is compromised and a decrease in operating efficiency is also brought about.

SUMMARY

The present invention is directed to achieving a high operating efficiency without compromising comfort by changing the water temperature of an outlet of the heat source unit in accordance with the change in the outside air temperature.

The temperature control system of the present invention includes a heat medium circuit that connects, in a looped manner with a pipe, a heat source device that is controlled to perform either heating or cooling of a heat medium flowing therein, the heat source device through which the heat medium flows out, a heat exchange device that exchanges heat with a subject to be temperature-controlled by having the heat medium pass therethrough, the heat exchanging device controlling a temperature of the subject to be controlled to a target temperature, and a conveying device that conveys the heat medium, the heat medium circuit circulating the heat medium therein with the conveying device;

a controller that controls, through the control of the heat source device, the temperature of the heat medium flowing out from the heat source device, and an outside air temperature sensor that detects an outside air temperature, in which the controller performs a first control that controls the temperature of the heat medium flowing out of the heat source device on the basis of the outside air temperature and a temperature difference between chronologically preceding and following outside air temperatures, the controller controlling the temperature of the subject to be controlled to the target temperature by performing the first control.

The invention changes the outlet water temperature of the heat source device in accordance with the change in the outside air temperature. As such, the air conditioning system can achieve high operating efficiency without compromising comfort.

DETAILED DESCRIPTION

Embodiment 1

General Configuration of Air Conditioning System

An air conditioning system 1 (a temperature control system) of Embodiment 1 will be described with reference to FIGS. 1 to 4.

Figure 1:
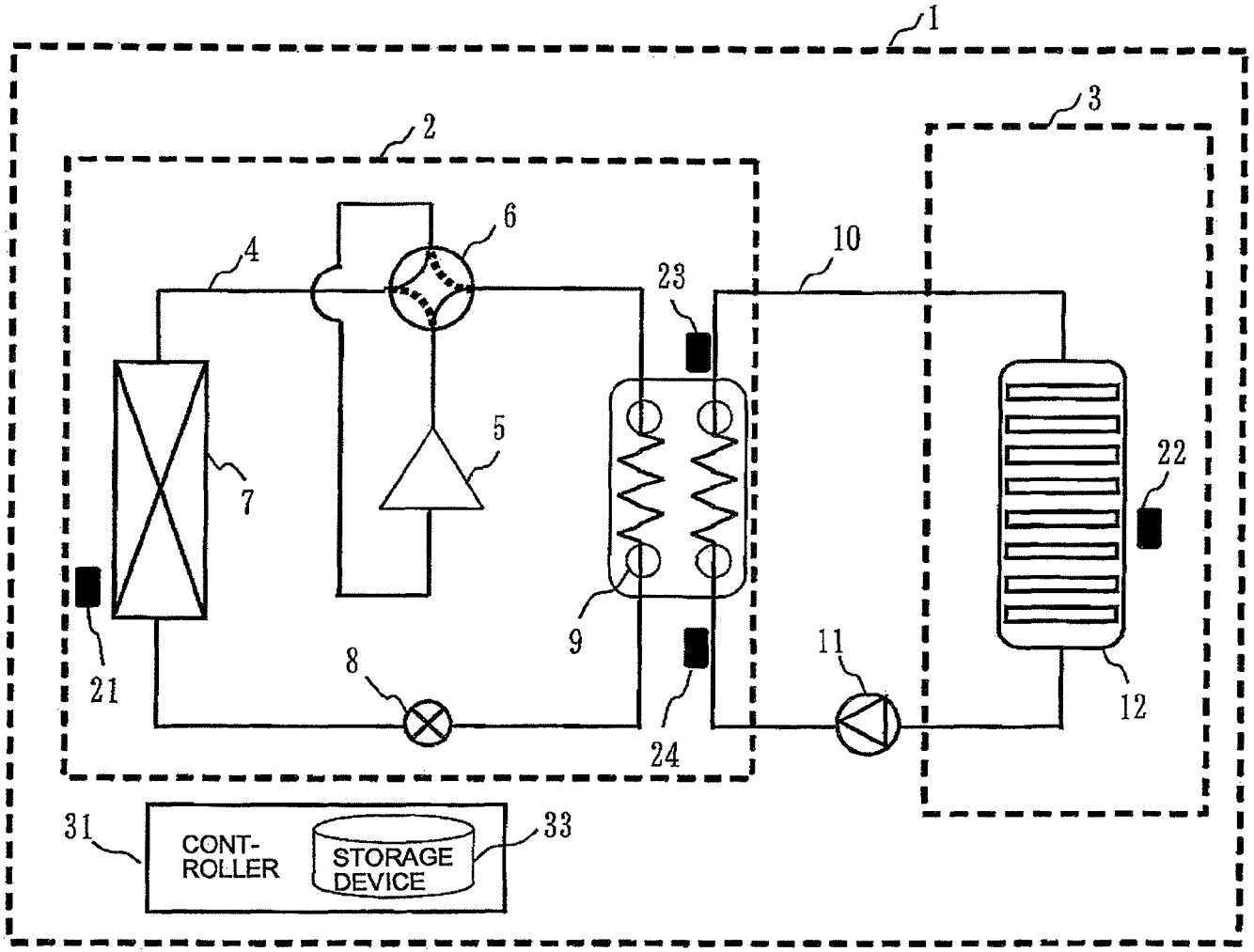
FIG. 1 is a block diagram of an air conditioning system of Embodiment 1.

FIG. 1 is a block diagram of the air conditioning system 1. The air conditioning system 1 includes a water circuit 10 (a heat medium circuit) and a controller 31. The water circuit 10 is constituted by connecting, in a looped manner with a pipe, an outdoor unit 2 (a heat source device), an indoor unit 3 (a heat exchange device), and a water pump 11 (a conveying device).

(1) The outdoor unit 2 is a heat source device including a refrigerant circuit 4. The outdoor unit 2 is controlled by the controller 31 such that water (heat medium) that flows into the outdoor unit 2 is heated or cooled and the water flows out. The outdoor unit 2 is controlled by the controller 31 so that the heating power or the cooling power of the water (heat medium) can be controlled.

(2) The indoor unit 3 includes an indoor heat exchanger 12 and is disposed in an indoor space. The indoor heat exchanger 12 exchanges heat with air (a subject of control) of the indoor space (a space subject to air conditioning) and controls the indoor temperature to a target temperature by having water having been heated or cooled by the outdoor unit 2 and passing therethrough.

(3) The water pump 11 conveys a heat medium such as water.

(4) The controller 31 controls the temperature of the water flowing out from the outdoor unit 2 through control of the outdoor unit 2.

The air conditioning system 1 further includes an outdoor temperature sensor 21 (an outside air temperature sensor) that is configured to detect an outdoor temperature (an outside air temperature), the temperature of outdoors where the outdoor unit 2 is disposed, an indoor temperature sensor 22 (control-subject-temperature sensor) configured to detect an indoor temperature (temperature of subject to be controlled), the temperature of indoors where the indoor unit 3 is disposed, an inlet water temperature sensor 23 that is configured to detect an inlet water temperature of the water flowing into the outdoor unit 2 (an intermediate heat exchanger 9), and an outlet water temperature sensor 24 that is configured to detect an outlet water temperature of the water flowing out of the outdoor unit 2 (the intermediate heat exchanger 9). The detection values of the outdoor temperature sensor 21 to the outlet water temperature sensor 24 are imported into the controller 31. As illustrated in FIG. 1, the controller 31 includes a storage device 33. The detection values of the outdoor temperature sensor 21 to the outlet water temperature sensor 24 are stored in the storage device 33.

(Refrigerant Circuit 4)

In the refrigerant circuit 4, a compressor 5, a four-way valve 6 configured to switch refrigerant passages, an outdoor heat exchanger 7 configured to exchange heat between outdoor air and a refrigerant, an expansion valve 8 serving as a decompression device, and the intermediate heat exchanger 9 configured to exchange heat between the water and the refrigerant are connected in a looped manner.

(Compressor 5)

The compressor 5 is a fully hermetic compressor, for example. Based on a command from the controller 31, the compressor 5 controls the flow rate of the refrigerant that circulates in the refrigerant circuit 4 by changing the rotation speed with an inverter. With this control, the heat exchange amount in the intermediate heat exchanger 9 is changed and, thus, the outlet water temperature of the outdoor unit 2 can be controlled.

(Four-Way Valve 6)

The four-way valve 6 is used to switch the flow of the refrigerant circuit 4. When there is no need to switch the flow of the refrigerant such as when the air conditioning system 1 is used exclusively for cooling or exclusively for heating, then there is no need to switch passages. If there is no need to switch passages, the four-way valve 6 does not need to be provided.

(Outdoor Heat Exchanger 7)

As the outdoor heat exchanger 7, a fin-and-tube heat exchanger, for example, can be used. The outdoor heat exchanger 7 is provided with an outdoor fan (not shown) in a case of being the fin-and-tube heat exchanger. In this case, the outdoor heat exchanger 7 facilitates heat exchange between the outside air supplied from the outdoor fan and the refrigerant. Furthermore, the outdoor heat exchanger 7 may be a type of outdoor heat exchanger that is buried in the ground so as to use geothermal heat and that can accordingly provide a source of heat with stable temperature throughout the year. Still further, as the outdoor heat exchanger 7, a plate heat exchanger may be used such that water or anti-freeze, for example, can be used as a heat source.

(Expansion Valve 8)

As the expansion valve 8, a component whose opening degree can be variably controlled, for example, is used. The opening degree is controlled such that the degree of sub-cooling at an outlet of the condenser or the degree of superheat at an outlet of the evaporator is as small as possible. The control of the opening degree allows the refrigerant flow rate to be controlled. Accordingly, the heat exchanger can be used effectively. Furthermore, the refrigerant flow rate can also be controlled with a plurality of fixed expansion devices, such as capillaries, arranged in parallel.

(Intermediate Heat Exchanger 9)

As the intermediate heat exchanger 9, a plate heat exchanger, for example, is used. The intermediate heat exchanger 9 exchanges heat between the refrigerant and the water, and supplies cold/hot water to the water circuit 10. Furthermore, a double tube heat exchanger or a flooded heat exchanger can be used as the intermediate heat exchanger 9 to obtain the same advantageous effects as that of the plate heat exchanger.

(Indoor Heat Exchanger 12)

The indoor unit 3 includes an indoor heat exchanger 12. The indoor heat exchanger 12 exchanges heat between the water and indoor air to heat or cool the indoor space. As the indoor heat exchanger 12, a radiator, for example, is used. The indoor space can be heated or cooled according to the temperature of the water flowing into the radiator. Furthermore, the indoor heat exchanger 12 is not limited to a radiator, and a fan coil unit, a floor heating panel, or the like may be employed as the indoor heat exchanger 12.

(Water Pump 11)

The water pump 11 supplies water serving as a heat medium to the outdoor unit 2 and the indoor unit 3. There are water pumps 11 in which the speed is constant and ones in which the rotation speed is made variable with an inverter or the like. Furthermore, a water pump 11 with a constant speed and a capacity control valve that can vary its opening degree may be combined and the opening degree of the capacity control valve may be controlled such that the flow rate of the circulating water can be controlled.

<Method of Determining Outlet Water Temperature of Intermediate Heat Exchanger 9>

A method will be described next in which the controller 31 in the air conditioning system 1 determines "a target outlet water temperature" of the intermediate heat exchanger 9 from a change in the outside air temperature. As an example, a case of a heating operation (Equation (6) set forth below) will be described. The control described below is carried out by the controller 31. Furthermore, "a target outlet water temperature determination method" described subsequently is directed to a first control described below. That is to say, the controller 31 maintains the indoor space at a constant temperature by performing control on the basis of Equation (A).

$$T_{wo(i)}=T_{wo(i-1)}+\Delta T1+\Delta T2 \quad \text{(A)}$$

where, $T_{wo(i)}$: the current outlet water temperature, $T_{wo(i-1)}$: an outlet water temperature before a predetermined time interval, ΔT1: an outlet water temperature change computed by the first control, and ΔT2: an outlet water temperature change computed by a second control.

More specifically, the controller 31 maintains the indoor temperature at a substantially constant temperature by two controls, that is, the second control (a control on the basis of the computation of ΔT2) that maintains the indoor temperature at a substantially constant temperature by controlling the outlet water temperature ($T_{wo(i)}$) of the water flowing out from the outdoor unit 2 (the intermediate heat exchanger 9) on the basis of the temperature difference between chronologically preceding and following indoor temperatures, and the first control (a control on the basis of the computation of ΔT1) that maintains the indoor temperature at a substantially constant temperature by controlling the outlet water temperature ($T_{wo(i)}$) of the water flowing out from the outdoor unit 2 on the basis of the outside air temperature and the temperature difference between chronologically preceding and following outside air temperatures.

The first control, which is performed on the basis of the temperature difference of the outside air temperatures, will be described below.

Note that in the following description, (i−1) refers to "a predetermined time period ago" and (i) refers to "after elapse of a predetermined time period".

Furthermore, in the following description, an inlet water temperature $T_{wi}$ and an outlet water temperature $T_{wo}$ refer to the inlet water temperature and the outlet water temperature, respectively, of the outdoor unit 2 (the intermediate heat exchanger 9).

The indoor load of the time before the predetermined time period, that is, a heat exchange amount $Q_{io(i-1)}$ between the indoor space and the outside air can be expressed by Equation (1), where, $AK_{io(i-1)}$ is a heat exchange performance of the building of the time before the predetermined time period, $T_{ai(i-1)}$ is an indoor temperature, and $T_{ao(i-1)}$ is an outside air temperature.

[Math. 1]

$$Q_{io(i-1)}=AK_{io(i-1)}\times(T_{ai(i-1)}-T_{ao(i-1)}) \quad (1)$$

Meanwhile, the heat exchange amount $Q_{w(i-1)}$ in the intermediate heat exchanger 9 can be expressed by Equation (2), where, $G_{w(i-1)}$ is the water flow rate, $Cp_{w(i-1)}$ is the specific heat of the water, $T_{wi(i-1)}$ is the inlet water temperature of the intermediate heat exchanger 9, and $T_{wo(i-1)}$ is the outlet water temperature of the intermediate heat exchanger 9.

[Math. 2]

$$Q_{w(i-1)}=G_{w(i-1)}\times Cp_{w(i-1)}\times(T_{wo(i-1)}-T_{wi(i-1)}) \quad (2)$$

Now, if the power $Q_{w(i-1)}$ of the intermediate heat exchanger 9 and the heat exchange amount $Q_{io(i-1)}$ between the indoor space and the outside air are in equilibrium, then, from Equation (1) and Equation (2), the relationship between the inflow temperature (the inlet water temperature $T_{wi(i-1)}$), the outflow temperature (the outlet water temperature $T_{wo(i-1)}$), the indoor temperature $T_{ai(i-1)}$, and the outside air temperature $T_{ao(i-1)}$ can be expressed by Equation (3).

[Math. 3]

$$(T_{wo(i-1)}-T_{wi(i-1)})=C1\times(T_{ai(i-1)}-T_{ao(i-1)}) \quad (3)$$

Note that C1 in Equation (3) is a constant determined from the water flow rate and the heat exchange performance of the building.

Here, if $T_{wo(i)}$ is the outlet water temperature in a case in which, subsequent to the change of the outside air temperature from $T_{ao(i-1)}$ to $T_{ao(i)}$, the indoor temperature matches the indoor temperature before the change, then the relationship between the target indoor temperature $T_{ai(i)}$ and the outlet water temperature $T_{wo(i)}$ is expressed by Equation (4).

[Math. 4]

$$(T_{wo(i)}-T_{wi(i)})=C1\times(T_{ai(i)}-T_{ao(i)}) \quad (4)$$

Furthermore, from Equation (3) and Equation (4), the relationship among the outlet and inlet water temperatures before the change in the outside air temperature (i−1), the indoor and outdoor temperatures before the change (i−1), the indoor and outdoor temperatures after the change (i), and the outlet and inlet water temperatures after the change (i) can be expressed by Equation (5).

[Math. 5]

$$\frac{(T_{wo(i)}-T_{wi(i)})}{(T_{wo(i-1)}-T_{wi(i-1)})}=\frac{(T_{ai(i)}-T_{ao(i)})}{(T_{ai(i-1)}-T_{ao(i-1)})} \quad (5)$$

Now, since it is assumed that the indoor temperature is not changed, $$T_{ai(i)}=T_{ai(i-1)} \quad (B)$$

establishes. Furthermore, it is assumed that the inlet water temperature does not change.

That is, $$T_{wi(i)}=T_{wi(i-1)} \quad (C)$$

is assumed.

Equation (6) is obtained when Equation (5) is transformed under the conditions of Equations (B) and (C). The controller 31 performs the first control that controls the temperature of the water that flows out from the outdoor unit 2 on the basis of, for example, Equation (6), and on the basis of the outside air temperature ($T_{ao(i-1)}$ of ($T_{ai(i-1)}-T_{ao(i-1)}$)) and the temperature difference between chronologically preceding and following outside air temperatures (($T_{ao(i-1)}-T_{ao(i)}$)). By performing the first control as such, the temperature of the indoor space that is subject to control is controlled to the target temperature. The same applies to Equation (7) for cooling that is described later. The transformation from Equation (5) to Equation (6) is as shown below.

The boxed portions in the following Equation (i) show where Equations (B) and (C) are substituted in Equation (5).

[Math. 6]

$$\frac{T_{wo(i)}-\boxed{T_{wi(i-1)}}}{T_{wo(i-1)}-\boxed{T_{wi(i-1)}}}=\frac{\boxed{T_{ai(i-1)}}-T_{ao(i)}}{\boxed{T_{ai(i-1)}}-T_{ao(i-1)}} \quad (i)$$

From($i$), $$T_{wo(i)}-T_{wi(i-1)}=\frac{T_{ai(i-1)}-T_{ao(i)}}{T_{ai(i-1)}-T_{ao(i-1)}}\times(T_{wo(i-1)}-T_{wi(i-1)}) \quad (ii)$$

By expanding both sides of (ii) by adding $-\{T_{wo(i-1)}-T_{wi(i-1)}\}$ to both sides, the left-hand side and the right-hand side of (ii) become the following.

$$\text{Left-hand side}=T_{wo(i)}-T_{wo(i-1)} \quad (iii)$$

$$\begin{aligned}\text{Right-hand side}&=\frac{T_{ai(i-1)}-T_{ao(i)}}{T_{ai(i-1)}-T_{ao(i-1)}}\times(T_{wo(i-1)}-T_{wi(i-1)})-\{T_{wo(i-1)}-T_{wi(i-1)}\}\\&=\left\{\frac{T_{ai(i-1)}-T_{ao(i)}}{T_{ai(i-1)}-T_{ao(i-1)}}-1\right\}\times(T_{wo(i-1)}-T_{wi(i-1)})\\&=\frac{T_{ao(i-1)}-T_{ao(i)}}{T_{ai(i-1)}-T_{ao(i-1)}}\times(T_{wo(i-1)}-T_{wi(i-1)})\end{aligned} \quad (iv)$$

Accordingly, from (iii) and (iv), $$T_{wo(i)}-T_{wi(i-1)}=\frac{T_{wo(i-1)}-T_{wi(i-1)}}{T_{ai(i-1)}-T_{ao(i-1)}}\times(T_{ao(i-1)}-T_{ao(i)})$$

Therefore, the following Equation (6) is obtained.

$$T_{wo(i)}=T_{wo(i-1)}+\frac{(T_{wo(i-1)}-T_{wi(i-1)})}{(T_{ai(i-1)}-T_{ao(i-1)})}\times(T_{ao(i-1)}-T_{ao(i)}) \quad (6)$$

The target outlet water temperature can be expressed by Equation (7) when a case of a cooling operation is derived in a manner similar to the derivation of Equation (6).

[Math. 7]

$$T_{wo(i)}=T_{wo(i-1)}+\frac{(T_{wi(i-1)}-T_{wo(i-1)})}{(T_{ao(i-1)}-T_{ai(i-1)})}\times(T_{ao(i-1)}-T_{ao(i)}) \quad (7)$$

That is to say, as in Equation (8), the target outlet water temperature for not changing the indoor temperature before and after the outside air temperature change can be determined so that the target outlet water temperature is proportional to the outside air temperature variation range ($T_{ao(i-1)}-T_{ao(i)}$).

[Math. 8]

$$T_{wo(i)}=T_{wo(i-1)}+\alpha\times(T_{ao(i-1)}-T_{ao(i)}) \quad (8)$$

Furthermore, the target outlet water temperature $T_{wo(i)}$ for making the indoor temperature before and the indoor temperature after the change in the outside air temperature ($T_{ao(i-1)}-T_{ao(i)}$) match each other can be determined from Equation (6), that is, from the thermal balance relationship between the heat exchange amount of the intermediate heat exchanger 9 ($T_{wo(i-1)}-T_{wi(i-1)}$), which is the power of the outdoor unit 2, and the indoor load ($T_{ai(i-1)}-T_{ao(i-1)}$). The same applies to Equation (7). Specifically, from Equation (6) or (7), Equation (9) can determine whether the target outlet water temperature $T_{wo(i)}$ is inversely proportional to an indoor-outdoor temperature difference, proportional to an outlet-inlet water temperature difference, or proportional to the ratio of the outlet-inlet water temperature difference to the indoor-outdoor temperature difference.

[Math. 9]

$$\text{Target Oulet Water Temperature} = \text{Current Outlet Water Temperature} + \frac{\text{Outside Air Temperature Difference}}{\text{Indoor Temperature Difference}} \times \text{Difference between Outlet Water Temperature and Inlet Water Temperature} \quad (9)$$

In the actual control, the target outlet water temperature is changed by multiplying a relaxation coefficient by the second term on the right-hand side of Equation (6) or Equation (7), and the controller 31 controls the outdoor unit 2 so that the indoor temperature ultimately matches the target indoor temperature.

<Specific Control Method>

(Course of Operation of Target Outlet Water Temperature During Heating Operation)

The control method of the outdoor unit 2 in which the controller 31 performs the above-described target outlet water temperature determination method will be described next.

Figure 2:
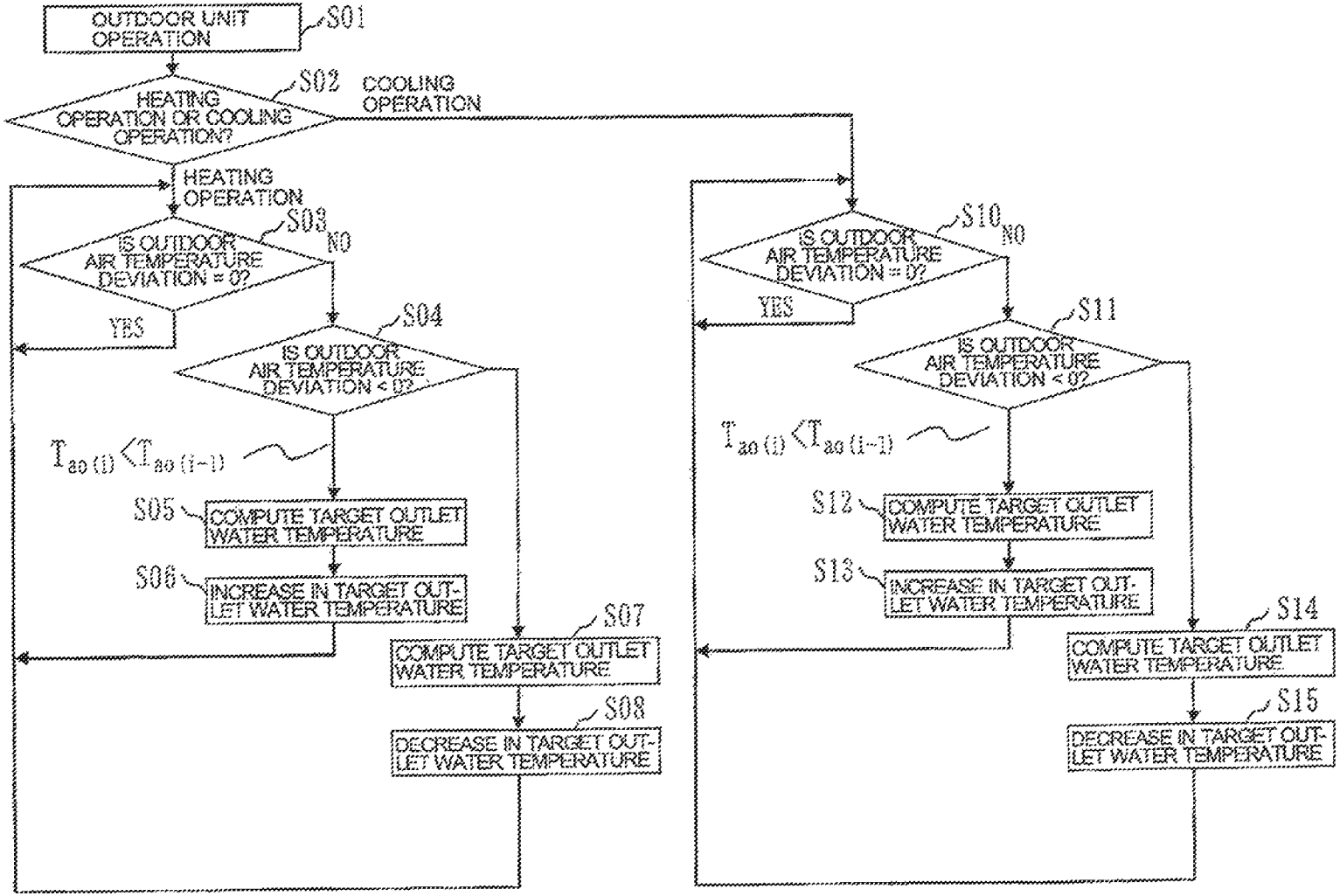
FIG. 2 is a flowchart illustrating a control operation carried out by the controller 31 of Embodiment 1.

FIG. 2 illustrates the course of change of the target outlet water temperature $T_{wo}$ during operation of the outdoor unit 2. FIG. 2 is an operation carried out by the controller 31. The operation of the outdoor unit 2 is started (S01), and either one of the heating operation and the cooling operation is selected (S02). During the heating operation, an outside air temperature difference ($T_{ao(i)}-T_{ao(i-1)}$), which is a difference between the current outside air temperature $T_{ao(i)}$ and the outside air temperature $T_{ao(i-1)}$ of the time before the predetermined time period, is computed. Comparison is carried out with the computed outside air temperature difference, and if the outside air temperature difference is zero or is within a predetermined range (S03), then the operation is continued with the current outlet water temperature. If the outside air temperature difference is below zero ($T_{ao(i)}<T_{ao(i-1)}$), that is, if the current outside air temperature $T_{ao(i)}$ is lower than the outside air temperature $T_{ao(i-1)}$ of the time before the predetermined time period (S04), the controller 31 sets the target outlet water temperature in accordance with Equation (6) described above using the outside air temperature difference (S05). At this time, since the outside air temperature difference is less than zero, the indoor load is large. Therefore, the controller 31 performs control towards increasing the target outlet water temperature $T_{wo(i)}$ so that it is higher than the current outlet water temperature $T_{wo(i-1)}$ (S06). On the other hand, if the outside air temperature difference is greater than zero ($T_{ao(i)}>T_{ao(i-1)}$), that is, if the current outside air temperature $T_{ao(i)}$ is higher than the outside air temperature $T_{ao(i-1)}$ of the time before the predetermined time period, then the target outlet water temperature is computed by Equation (6) in the similar manner (S07), and the controller 31 performs control towards decreasing the target outlet water temperature $T_{wo(i)}$ so that it is lower than the current outlet water temperature $T_{wo(i-1)}$ (S08).

(Course of Operation of Target Outlet Water Temperature During Cooling Operation)

Next, a description will be made of the cooling operation. When it is determined to be the cooling operation (S02), similar to the heating operation, the controller 31 performs a determination on the basis of the computed outside air temperature difference ($T_{ao(i)}-T_{ao(i-1)}$) (S10). If the outside air temperature difference is zero or is within a predetermined range, the controller 31 continues the changing operation with the current target outlet water temperature. If the outside air temperature difference is less than zero ($T_{ao(i)}<T_{ao(i-1)}$), that is, if the current outside air temperature $T_{ao(i)}$ is lower than the outside air temperature $T_{ao(i-1)}$ of the time before the predetermined time period (S11), the target outlet water temperature is computed with Equation (7) (S12). At this time, since the outside air temperature difference is less than zero, the indoor load is small. Therefore, the controller 31 performs control to increase the target outlet water temperature $T_{wo(i)}$ so that it is higher than the current outlet water temperature $T_{wo(i-1)}$ (S13). On the other hand, if the outside air temperature difference is greater than zero ($T_{ao(i)}>T_{ao(i-1)}$), that is, if the current outside air temperature $T_{ao(i)}$ is higher than the outside air temperature $T_{ao(i-1)}$ of the time before the predetermined time period, then, the target outlet water temperature is computed from Equation (7) in a similar manner (S14). Further, since the indoor load becomes high, the indoor temperature needs to be reduced. Therefore, the controller 31 performs control to decrease the target outlet water temperature $T_{wo(i)}$ so that it is lower than the current outlet water temperature $T_{wo(i-1)}$ (S15).

Next, the influence of "the difference between the indoor temperature and the outside air temperature" and "the difference between the inlet water temperature and the outlet water temperature" described in Equation (6) and Equation (7) that are formulas for computation of the target outlet water temperature $T_{wo(i)}$ will be described with the heating operation as an example.

(Difference Between Indoor Temperature and Outdoor Air Temperature; Influence of Outdoor Air Temperature)

Regarding Equation (6) for the heating operation, "the difference between the indoor temperature and the outside air temperature" ($T_{ai(i-1)}-T_{ao(i-1)}$) will be described.

Figure 3:
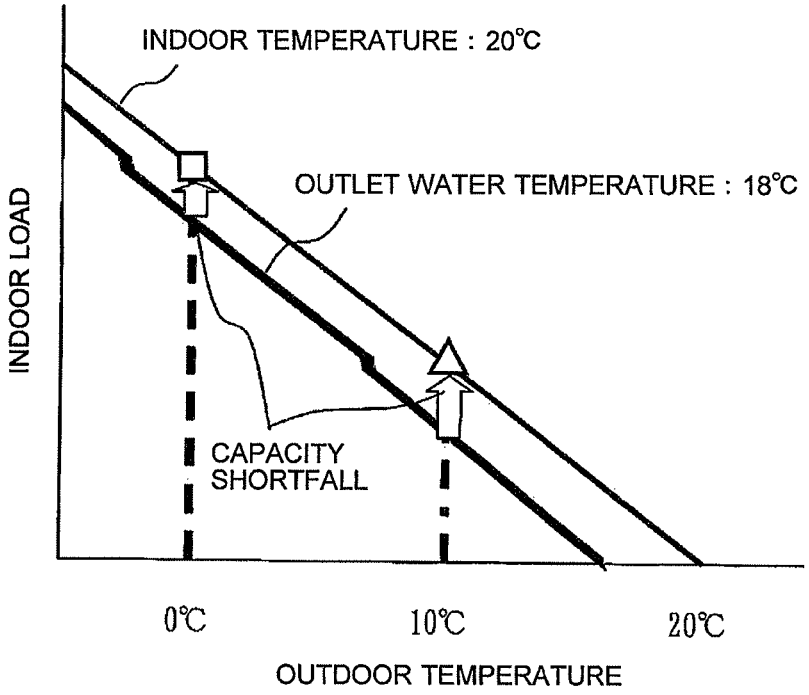
FIG. 3 is a graph showing the relationship between an outdoor temperature and an indoor load of Embodiment 1.

FIG. 3 is a graph showing the relationship between the outdoor temperature (outside air temperature) and the indoor load. The outdoor temperature is taken on an axis of abscissas and the indoor load is taken on an axis of ordinates. If the indoor temperature is fixed (indoor temperature=20 degrees C., for example), then the indoor load during the heating operation is, as shown in FIG. 3, large when the outside air temperature is low (0 degrees C., for example) and is small when the outside air temperature is high (10 degrees C., for example). Here, discussion will be made regarding the variation range of the target outlet water temperature in a case in which the outside air temperature changes. First, it is assumed that the indoor temperature=20 degrees C. and that the outside air temperature has increased from 0 degrees C. to 2 degrees C. As shown in Equation 1, the difference between the outside air temperature and the indoor temperature is proportional to the indoor load. Accordingly, regarding the outdoor unit power for not changing the indoor temperature even with the rise in the outside air temperature, the indoor temperature is stable when the power of the outdoor unit 2 is (20 degrees C.−2 degrees C.)/(20 degrees C.−0 degrees C.)×100=90% with respect to the power of the outdoor unit 2 before the outside air temperature rise. That is, with a reduction of the target outlet water temperature amounting to 10% of the current power of the outdoor unit 2, change of the indoor temperature can be prevented even with the increase in the outside air temperature.

On the other hand, if the outside air temperature increases from 10 degrees C. to 12 degrees C., the outdoor unit power for not changing the indoor temperature will be (20 degrees C.−12 degrees C.)/(20 degrees C.−10 degrees C.)×100=80%.

In this case, it can be said that, with a reduction of the target outlet water temperature amounting to 20% of the power of the outdoor unit 2, the indoor temperature will match the preset temperature.

Figure 4:
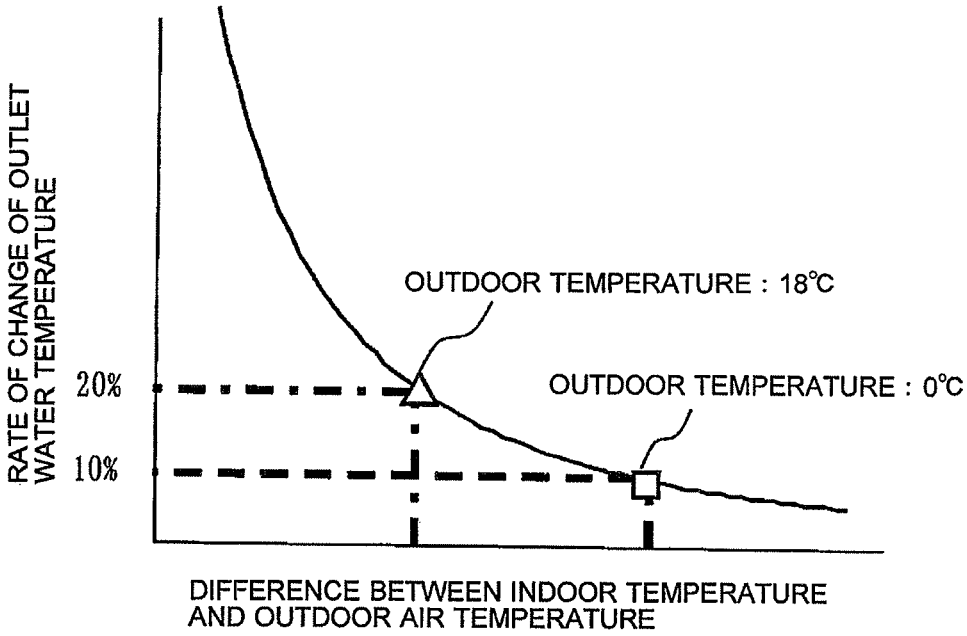
FIG. 4 is a graph showing a relationship between a difference between an indoor temperature and an outside air temperature and a rate of change of an outlet water temperature of Embodiment 1.

FIG. 4 is a graph showing a relationship between the difference between the indoor temperature and the outside air temperature and a rate of change of the outlet water temperature. That is, as shown in FIG. 4, even if the outside air temperature difference is the same (in the above example, the difference is 2 degrees C.), when the outside air temperature is high (when the difference between a preset indoor temperature and the outside air temperature is small), the rate of change of the target outlet water temperature becomes high. Furthermore, when the outside air temperature is low (when the difference between the preset indoor temperature and the outside air temperature is large), the rate of change of the target outlet water temperature becomes low. The newly set target outlet water temperature is inversely proportional to the difference between the indoor temperature and the outside air temperature.

(Influence of Temperature Difference Between Water Temperatures)

The influence of "the difference between the inlet water temperature and the outlet water temperature" ($T_{wo(i-1)}-T_{wi(i-1)}$) will be described next. When the water flow rate is constant, "the difference between the inlet water temperature and the outlet water temperature" indicates the power of the outdoor unit 2. When the water flow rate is constant, it can be said that if "the difference between the inlet water temperature and the outlet water temperature" is large, the power of the outdoor unit 2 is large, that is, the indoor load is large. When Equation (5) is transformed, as shown in Equation (10), the difference between the outlet water temperature and the inlet water temperature after the change in the outside air temperature is in a proportional relationship with the difference between the outlet water temperature and the inlet water temperature of the time one period before.

[Math. 10]

$$(T_{wo(i)}-T_{wi(i)})=\beta\times(T_{wo(i-1)}-T_{wi(i-1)}) \quad (10)$$

Now, a case in which the power of the outdoor unit 2 is large, that is, a case in which "the difference between the inlet water temperature and the outlet water temperature" is large (for example, the outlet water temperature is 40 degrees C. and "the difference between the inlet water temperature and the outlet water temperature"=10 degrees C.), and a case in which the power of the outdoor unit 2 is small, that is, "the difference between the inlet water temperature and the outlet water temperature" is small (for example, the outlet water temperature is 35 degrees C. and "the difference between the inlet water temperature and the outlet water temperature"=5 degrees C.) will be discussed.

Assuming that $T_{womH}$ is the target outlet water temperature in a case in which the power of the outdoor unit 2 is large, and $T_{womL}$ is the target outlet water temperature in a case in which the power of the outdoor unit 2 is small, then from Equation (9), the relationship between the current inlet water temperature (30 degrees C.), the outlet water temperature (40 degrees C. or 35 degrees C.), and the target outlet water temperature $T_{wo}$ is expressed by Equation (11) or Equation (12).

[Math. 11]

$$(T_{womH}-T_{wi})=\beta\times(40^\circ\text{ C.}-30^\circ\text{ C.})\rightarrow T_{womH}=\beta\times10+T_{wi} \quad (11)$$

[Math. 12]

$$(T_{womL}-T_{wi})=\beta\times(35^\circ\text{ C.}-30^\circ\text{ C.})\rightarrow T_{womL}=\beta\times5+T_{wi} \quad (12)$$

Since the inlet water temperatures are the same (30 degrees C.), regarding the target outlet water temperatures, $T_{womL}<T_{womH}$ holds true. Therefore, when the power of the outdoor unit 2 is large, the difference between the target outlet water temperature and the current outlet water temperature needs to be large.

In other words, when the indoor load, that is, the power of the outdoor unit 2, is large, the variation range of the target outlet water temperature may be large, and when the outdoor unit power is small, the variation range of the target outlet water temperature may be small. That is to say, the target outlet water temperature is proportional to the outlet-inlet water temperature difference.

Modification 1 of Embodiment 1

In the above description, a description is given of a case in which the water flow rate is constant. A description of a case in which a pump flow rate can be controlled such that "the difference between the inlet water temperature and the outlet water temperature" is constant at all times will be given next in a case in which the pump flow rate of the water pump 11 is variable by control of the controller 31. In the above case in which the pump flow rate can be controlled such that "the difference between the inlet water temperature and the outlet water temperature" is constant at all times, a flowmeter is installed between the outdoor unit 2 and the indoor heat exchanger 12, and the controller 31 detects the pump flow rate with the flowmeter. Alternatively, the controller 31 detects a value representing the flow rate, such as the rotation speed of the water pump 11 or the opening degree of the flow control valve. The controller 31 may use a value (a flow-rate index value) representing the pump flow rate, such as the above-described pump flow rate, the rotation speed of the water pump 11, or the opening degree of the flow control valve as an alternative for "the difference between the inlet water temperature and the outlet water temperature". In this way, as an alternative for "the difference between the inlet water temperature and the outlet water temperature", the controller 31 may use a difference between chronologically preceding and following flow-rate index values, which are flow-rate index values that index the flow rate of the water conveyed by the water pump 11.

Modification 2 of Embodiment 1

Furthermore, in the above description, it has been assumed that the current outside air temperature and the outside air temperature of the time before the predetermined time period are used as the $T_{ao(i)}$ and the $T_{ao(i-1)}$, respectively, of the outside air temperature difference ($T_{ao(i-1)}-T_{ao(i)}$). In the above, regarding the current outside air temperature and the outside air temperature of the time before the predetermined time period, a mean outside air temperature during a certain period ΔTa may be used as $T_{ao(i-1)}$, and a mean outside air temperature during a certain period ΔTb that is a period after the period ΔTa may be used as $T_{ao(i)}$, for example. Furthermore, for example, an outside air temperature after a predetermined time period may be estimated from the outside air temperature of the current and past times and a difference between the estimated outside air temperature and the current outside air temperature may be adopted.

(Control Based on Outdoor Air Temperature Difference)

As described above, in Embodiment 1, as shown in Equations (6) to (9) and the like, in a case in which the target value of the temperature of the outflowing heat medium that flows out from the outdoor unit 2 (heat source device) is determined for maintaining the indoor temperature at a constant temperature, the controller 31 determines the target outflowing heat medium temperature so that it is proportional to the temperature difference obtained by using the current detection value and the detection value of the time before the predetermined time period from the detection values of the outdoor temperature sensor 21. With this determination method, in the air conditioning system 1, it is possible to set the target outflowing heat medium temperature in accordance with the change in the indoor load that is associated with the outside air temperature change, and, thus, it is possible to achieve control with high operating efficiency without compromising the comfort of a user.

(Control Taking Indoor-Outdoor Temperature Difference into Consideration)

Furthermore, as shown in Equations (6) to (9) and the like, in a case in which the target value of the temperature of the outflowing heat medium that flows out from the outdoor unit 2 is determined for maintaining the indoor temperature at a constant temperature, the controller 31 determines the target outflowing heat medium temperature such that it is proportional to the temperature difference obtained by using the current detection value and the detection value of the time before the predetermined time period from the detection values of the outdoor temperature sensor 21, and such that it is inversely proportional to the difference between the detection value of the indoor temperature sensor 22 and that of the outdoor temperature sensor 21. With this determination method, in the air conditioning system 1, it is possible to set the target outflowing heat medium temperature in accordance with the indoor load, and, thus, it is possible to achieve control with high operating efficiency without compromising the comfort of the user.

(Control Taking "Difference between Inlet Water Temperature and Outlet Water Temperature" into Consideration)

Furthermore, as shown in Equations (6) to (9), etc, in a case in which the target value of the temperature of the outflowing heat medium that flows out from the outdoor unit 2 is determined for maintaining the indoor temperature at a constant temperature, the controller 31 determines the target outflowing heat medium temperature such that it is proportional to the temperature difference obtained by using the current detection value and the detection value of the time before the predetermined time period from the detection values of the outdoor temperature sensor 21, and such that it is proportional to "the difference between the inlet water temperature and the outlet water temperature" (detected by the inlet water temperature sensor 23 and the outlet water temperature sensor 24, respectively). With this determination method, in the air conditioning system 1, it is possible to set the target outflowing heat medium temperature in accordance with the indoor load, and, thus, it is possible to achieve control with high operating efficiency without compromising the comfort of the user.

(Control Taking Pump Flow Rate into Consideration Instead of "Difference Between Indoor Temperature and Outdoor Temperature")

Furthermore, as described in the above "Modification 1 of Embodiment 1", in a case in which the target value of the temperature of the outflowing heat medium that flows out from the outdoor unit 2 is determined, the controller 31 determines the target outflowing heat medium temperature such that it is proportional to the temperature difference obtained by using the current detection value and the detection value of the time before the predetermined time period from the detection values of the outdoor temperature sensor 21, and such that it is proportional to the pump flow rate. With this determination method, in the air conditioning system 1, it is possible to set the target outflowing heat medium temperature in accordance with the indoor load, and, thus, it is possible to achieve control with high operating efficiency without compromising the comfort of the user.

(Control Taking Indoor-Outdoor Temperature Difference and "Difference Between Inlet Water Temperature and Outlet Water Temperature" into Consideration or Control Taking Indoor-Outdoor Temperature Difference and Pump Flow Rate into Consideration)

Furthermore, in a case in which the target value of the temperature of the outflowing heat medium that flows out from the outdoor unit 2 is determined, as shown in Equation (9) and the above-described "Modification 1 of Embodiment 1", the controller 31 determines the target outlet water temperature such that it is proportional to the temperature difference obtained by using the current detection value and the detection value of the time before the predetermined time period from the detection values of the outdoor temperature sensor 21, and such that it is proportional to the value obtained by dividing "the difference between the inlet water temperature and the outlet water temperature" or the pump flow rate by the indoor-outdoor temperature difference. With this determination method, it is possible to set the target outflowing heat medium temperature in accordance with each of the indoor load and the power of the outdoor unit 2, and, thus, it is possible to achieve control with high operating efficiency without compromising the comfort of the user.

(When Preset Indoor Temperature and Indoor Detection Temperature Match Each Other by Second Control)

Furthermore, when the controller 31 is provided with a control (second control) configured to set the target outlet water temperature according to the difference between the current indoor temperature and the preset indoor temperature, there are cases in which the preset temperature and the indoor temperature are determined as matching each other even when the indoor load has been changed by the outside air temperature change. This occurs when the change in the indoor temperature is small due to the heat capacity of the building so that the indoor temperature sensor 22 is unable to detect it. In such a case, the target outlet water temperature cannot be changed with the second control alone even when there is a change in the indoor load. However, in the air conditioning system 1, as described above, the first control is also used. Therefore, it is possible to set the target outlet water temperature with the outside air temperature change. Accordingly, it is possible to achieve control with high operating efficiency without compromising the comfort of the user. In this way, the controller 31 executes the first control even when the execution of the second control determines that the indoor temperature is maintained at a substantially constant temperature.

(Operation Period of First Control and Second Control)

The response period for the indoor temperature is different from that for the outside air temperature. In the controller 31, the computing interval of the term (the $\Delta T2$ in the above Equation (A)) that changes the target outlet water temperature in accordance with the difference between the preset indoor temperature and the indoor temperature (detection value), and the computing interval of the term (the $\Delta T1$ in the above Equation (A)) that changes the target outlet water temperature in accordance with the outside air temperature difference range are different. As above, the controller 31 periodically executes a first computation for the first control and a second computation for the second control. At this time, the period of execution of the first computation and the period of execution of the second computation are made to be different. Accordingly, the controller 31 can accurately detect the temperature to be used, and, thus, the target outlet water temperature can be set reliably.

(Employment of Heat Pump Device)

Furthermore, a capacity variable heat pump device may be used as the outdoor unit 2. The capacity variable heat pump device has a high operating efficiency and facilitates changing of the target outlet water temperature. As such, the amount of electric power consumption can be suppressed.

(Defrosting Operation and Detection Value of Outdoor Air Temperature)

When the outdoor unit 2 is a heat pump device, there is a need for a defrosting operation since frost is formed during the heating operation. Therefore, the outdoor temperature sensor 21 is affected by the temperature of the outdoor heat exchanger 7 that is in the middle of defrosting. Hence, it cannot detect the outside air temperature accurately. Accordingly, the controller 31 does not adopt the outside air temperature during the defrosting operation and the outside air temperature of a predetermined period (3 minutes or shorter, for example) after the defrosting has ended. With the above, the outside air temperature can be detected accurately.

According to Embodiment 1, in the air conditioning system 1 in which the load device and the heat source device are connected by a water circuit, high operating efficiency is achieved without compromising comfort by having the heat source device change the water temperature in accordance with the indoor load.

In the above Embodiment 1, while a description is given of a case in which the indoor unit 3 (the heat exchange device) performs temperature control of the indoor air, the case is an example. The target of the temperature control carried out by the temperature control system is not limited to air and may be water used for hot-water supply or may be water stored in a tank. In this example, water is circulated in the water circuit 10 as the heat medium. The water used for hot-water supply is heated by the water circulating in the water circuit 10, and, thus, a water-water heat exchanger is used for the heat exchange device.

In the above Embodiment 1, the air conditioning system 1 has been described. The control carried out by the controller 31 of the air conditioning system 1 may be recognized as a control method applied to the air conditioning system 1.

The invention claimed is:

1. A temperature control system, comprising:

a heat medium circuit that connects, with a pipe, a heat source device that is controlled to perform either heating or cooling of a heat medium flowing therein and allow the heat medium to flow out therefrom, a heat exchange device that exchanges heat with a subject to be temperature-controlled by allowing the heat medium to pass therethrough, to thereby control a temperature of the subject to be controlled to a target temperature, and a conveying device that conveys the heat medium, the heat medium circuit circulating the heat medium therein with the conveying device;

a controller that controls, through the control of the heat source device, a temperature of the heat medium flowing out from the heat source device, and an outside air temperature sensor that detects an outside air temperature, wherein the controller is configured to perform a first control that controls the temperature of the heat medium flowing out of the heat source device on a basis of the outside air temperature and a temperature difference between chronologically preceding and following outside air temperatures, to thereby control the temperature of the subject to be controlled to be the target temperature, wherein the controller is configured to, when executing the first control, use any of:

(1) a temperature difference between a temperature at a past time of the subject to be controlled and an outside air temperature of the past time, and (2) a temperature difference between an inflow temperature at a past time and an outflow temperature at the past time of the heat medium that had flowed into and out of the heat source device, in addition to the outside air temperature and the temperature difference between the chronologically preceding and following outside air temperatures.

2. The temperature control system of claim 1, wherein the controller is configured to use, when executing the first control, the temperature difference between the temperature at the past time of the subject to be controlled and the outside air temperature of the past time, and a difference between chronologically preceding and following flow-rate index values, each of the flow-rate index values indexing a flow rate of the heat medium that is conveyed by the conveying device, in addition to the outside air temperature and the temperature difference between the chronologically preceding and following outside air temperatures.

3. The temperature control system of claim 1, wherein the controller is configured to, when executing the first control, use the temperature difference between the temperature at the past time of the subject to be controlled and the outside air temperature of the past time, in addition to the outside air temperature and the temperature difference between the chronologically preceding and following outside air temperatures, and control the temperature of the heat medium flowing out from the heat source device on a basis of a value of a ratio of the temperature difference between the chronologically preceding and following outside air temperatures to the temperature difference between the temperature at the past time of the subject to be controlled and the outside air temperature of the past time.

4. The temperature control system of claim 1, wherein the controller is configured to, when executing the first control, use the temperature difference between the inflow temperature at the past time and the outflow temperature at the past time of the heat medium that had flowed into and out of the heat source device, in addition to the outside air temperature and the temperature difference between the chronologically preceding and following outside air temperatures, and control the temperature of the heat medium flowing out from the heat source device on a basis of a value of a product of the temperature difference between the chronologically preceding and following outside air temperatures and the temperature difference between the inflow temperature at the past time and the outflow temperature at the past time of the heat medium that had flowed into and out of the heat source device.

5. The temperature control system of claim 1, wherein the controller is configured to, when executing the first control, use a difference between chronologically preceding and following flow-rate index values, each of the flow-rate index values indexing a flow rate of the heat medium that is conveyed by the conveying device, in addition to the outside air temperature and the temperature difference between the chronologically preceding and following outside air temperatures, and control the temperature of the heat medium flowing out from the heat source device on a basis of a value of a product of the temperature difference between the chronologically preceding and following outside air temperatures and the difference between the chronologically preceding and following flow-rate index values, each of the flow-rate index values indexing a flow rate of the heat medium that is conveyed by the conveying device.

6. The temperature control system of claim 2, wherein the controller is configured to, when executing the first control, control the temperature of the heat medium flowing out from the heat source device on a basis of a value of a product obtained by multiplying a value of a ratio of the temperature difference between the chronologically preceding and following outside air temperatures to the temperature difference between the temperature at the past time of the subject to be controlled and the outside air temperature of the past time by the difference between the chronologically preceding and following flow-rate index values, each of the flow-rate index values indexing a flow rate of the heat medium that is conveyed by the conveying device.

7. The temperature control system of claim 1, further comprising:

a control-subject-temperature sensor that detects the temperature of the subject to be controlled, wherein the controller performs a second control that controls the temperature of the heat medium flowing out of the heat source device on the basis of the temperature of the subject to be controlled detected by the control-subject-temperature sensor, and uses the first control and the second control to control the temperature of the subject to be controlled to be the target temperature.

8. The temperature control system of claim 7, wherein the controller executes the first control even when determining that the temperature of the subject is controlled to be maintained at a substantially constant temperature by the execution of the second control.

9. The temperature control system of claim 7, wherein the controller periodically executes a first computation for the first control and a second computation for the second control, and a period of execution of the first computation is configured to be different from a period of execution of the second computation.

10. The temperature control system of claim 1, wherein a heat pump device is employed as the heat source device, the heat pump device is capable of performing a defrosting operation, and the controller excludes, from the outside air temperature for the first control, the outside air temperatures during a period of the defrosting operation and a predetermined period during switching from the defrosting operation to a normal operation.

11. An air conditioning system comprising the temperature control system recited in claim 1 to perform air conditioning of indoor air, the indoor air being the subject to be controlled, with the heat exchange device.

12. A temperature control system, comprising:

a heat medium circuit that connects, with a pipe, a heat source device that is controlled to perform either heating or cooling of a heat medium flowing therein and allow the heat medium to flow out therefrom, a heat exchange device that exchanges heat with a subject to be temperature-controlled by allowing the heat medium to pass therethrough, to thereby control a temperature of the subject to be controlled to a target temperature, and a conveying device that conveys the heat medium, the heat medium circuit circulating the heat medium therein with the conveying device;

a controller that controls, through the control of the heat source device, a temperature of the heat medium flowing out from the heat source device, and an outside air temperature sensor that detects an outside air temperature, wherein the controller is configured to perform a first control that controls the temperature of the heat medium flowing out of the heat source device on a basis of the outside air temperature and a temperature difference between chronologically preceding and following outside air temperatures, to thereby control the temperature of the subject to be controlled to be the target temperature, wherein the controller is configured to use, when executing the first control, a temperature difference between a temperature at a past time of the subject to be controlled and an outside air temperature of the past time, and a temperature difference between an inflow temperature at the past time and an outflow temperature at the past time of the heat medium that had flowed into and out of the heat source device, in addition to the outside air temperature and the temperature difference between the chronologically preceding and following outside air temperatures.

13. The temperature control system of claim 12, wherein the controller is configured to, when executing the first control, control the temperature of the heat medium flowing out from the heat source device on the basis of a value of a product obtained by multiplying a value of a ratio of the temperature difference between the chronologically preceding and following outside air temperatures to the temperature difference between the temperature at the past time of the subject to be controlled and the outside air temperature of the past time by the temperature difference between the inflow temperature at the past time and the outflow temperature at the past time of the heat medium that had flowed into and out of the heat source device.

* * * * *